US007140415B1

(12) United States Patent
Wilson et al.

(10) Patent No.: US 7,140,415 B1
(45) Date of Patent: Nov. 28, 2006

(54) METHOD AND APPARATUS FOR DIRECT POUR CASTING

(75) Inventors: Dennis Wilson, South Lyon, MI (US); Venkat Nara, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 11/163,781

(22) Filed: Oct. 31, 2005

(51) Int. Cl.
*B22D 37/00* (2006.01)

(52) U.S. Cl. ..... 164/337; 164/359; 164/360

(58) Field of Classification Search ..... 164/133, 164/335, 359, 360, 134, 136, 337
See application file for complete search history.

(56) References Cited

U.S. PATENT DOCUMENTS

| | | | | |
|---|---|---|---|---|
| 1,321,300 | A | | 11/1919 | Gathmann |
| 1,323,583 | A | | 12/1919 | Earnshaw |
| 2,433,109 | A | * | 12/1947 | Fouron ..... 164/254 |
| 3,598,175 | A | * | 8/1971 | Olsson et al. ..... 164/348 |
| 4,094,495 | A | * | 6/1978 | Kutscher et al. ..... 266/143 |
| 4,121,651 | A | | 10/1978 | Zeppellini |
| 4,222,505 | A | | 9/1980 | Daussan et al. |
| 4,478,270 | A | | 10/1984 | Rosenthal et al. |
| 4,961,460 | A | | 10/1990 | Butler et al. |
| 5,207,974 | A | | 5/1993 | Yun |
| 5,456,777 | A | | 10/1995 | Park et al. |
| 5,503,214 | A | | 4/1996 | Cribley et al. |
| 6,591,895 | B1 | | 7/2003 | Tabatabaei et al. |

FOREIGN PATENT DOCUMENTS

| | | | |
|---|---|---|---|
| SU | 1694317 | * | 11/1991 |

* cited by examiner

*Primary Examiner*—Kevin Kerns
*Assistant Examiner*—I.-H. Lin
(74) *Attorney, Agent, or Firm*—Raymond L. Coppiellie; Brooks Kushman P.C.

(57) ABSTRACT

A direct pour metal casting process and casting mold having a direct pour passage. The casting mold is filled from a bottom pour ladle that dispenses molten metal into a riser core. The riser core defines an opening that progresses from a circular opening in the top to a slot opening in the bottom of the riser core that is generally shaped as an inverted funnel.

7 Claims, 2 Drawing Sheets

METHOD AND APPARATUS FOR DIRECT POUR CASTING

BACKGROUND OF THE INVENTION

1. Field of the Invention

The present invention relates to a machine and method for casting metal parts by directly pouring molten metal from a bottom pour ladle into a mold.

2. Background Art

Molten metal may be cast in molds to form a wide variety of products. Examples of products formed in casting processes include engine heads, engine blocks, transmission housings and a wide variety of other parts. Metal castings may be formed of iron, aluminum or other metals and alloys. Metal casting molds may be sand cast molds, permanent molds or semipermanent molds. Interior cavities may be formed in castings by sand cores or permanent cores. The cores are used to define passages and orifices in a cast metal part and also may be used to lighten the finished cast part.

In casting lines for production casting operations, such as those used to manufacture engine heads, metal to be cast is initially melted in a melting department and then is transferred by means of a transfer ladle to a holding furnace near the casting line. The casting mold is filled by a pouring ladle that transfers molten metal from the holding furnace to a pouring basin on the casting mold. The molten metal flows from the pouring basin through a gating system comprising a network of runners that supply the molten metal to the cavity in the casting mold. The gating system normally supplies molten metal through an ingate in the bottom of the mold cavity. The gating system is designed to avoid turbulence and splashing as the molten metal enters the mold cavity. Turbulence and splashing of the molten metal can cause air to become entrapped in the molten metal as it solidifies, resulting in undesirable porosity in the cast part.

The cost of the metal casting mold is increased by the need to form the gating system. The gating system is made up of a series of passageways extending from the pouring basin to the casting cavity.

One disadvantage of conventional gating systems is as the molten metal flows through the gating system heat is lost to the mold surrounding sprues, runners, and ingates. The molten metal begins to solidify as it cools and, as a result, the metal must be initially heated to a higher temperature to compensate for heat losses as the metal flows through the gating system. Heating metal to a greater extent increases the energy costs that in turn increase the cost of the casting process. Increased energy costs may be incurred both in the initial melting operation and at the holding furnace.

After the casting operation is complete, the metal in the gating system solidifies. The solidified metal in the gating system is mechanically removed from the casting. The yield of a casting operation may be characterized as the ratio of the weight of the rough casting to the poured weight of molten metal. The metal that solidifies in the gating system reduces the yield of the casting operation.

Another disadvantage of the conventional metal casting mold having such a gating system is that inclusions, impurities and oxides may be entrained in the molten metal as it flows through the gating system. The inclusion of oxides in the molten metal may be increased if the molten metal is exposed to oxygen in the in-gate area.

A proposed solution for the above problems is disclosed in U.S. Pat. No. 4,961,460 that discloses a pouring process in which a ceramic sleeve including a filter is provided on top of a sprue that leads into a mold cavity. The sleeve is formed of a ceramic, or refractory, material and supports a ceramic foam filter. The molten metal flows through the filter in a smooth, substantially non-turbulent flow into the mold cavity. One problem with this process is the cost incurred for the refractory sleeve and filter. Difficulties are also encountered relating to retention of the filter in the ceramic sleeve and securing the ceramic sleeve in the mold during the pouring process. The pouring basin requires attachment to the mold when the mold is built and requires periodic replacement. Replacement of the pouring basin further adds to the cost of the process. After each pour, solidified metal in the pouring basin requires re-melting and replacement of the refractory sleeve and filter.

Applicants' invention provides a direct pour casting process that eliminates the need to provide a ceramic pouring basin and filter. Applicants' invention also eliminates the need for extensive gating systems of conventional casting molds and the costs incurred to compensate for thermal losses and other problems associated with conventional casting molds. Applicants' invention is summarized below.

SUMMARY OF THE INVENTION

According to one aspect of the present invention, a machine for casting a metal part is provided. The machine comprises a mold defining a mold cavity having a riser core. The riser core has a molten metal receiving opening that is located above a first side of the mold cavity. A bottom pour ladle is provided that has a metal dispensing in the bottom of the ladle and a stopper rod valve for opening and closing the metal dispensing opening in the ladle. The riser core has a circular opening on the top end and an elongated slot opening on the bottom of the riser core. The elongated slot opening extends along a portion of a first side of the mold cavity. The riser core defines an inverted funnel-shaped passage extending from the circular opening to the slot opening.

According to other aspects of the invention, the circular opening of the riser core may have a first cross-sectional area and the slot opening of the riser core has a second cross-sectional area that is less than the cross-sectional area of the circular opening, wherein positive pressure is applied as the molten metal fills the riser core. The riser core extends from the circular opening to the slot opening with a continuously increasing cavity width and a continuously decreasing cavity thickness. The riser core is disposed above the mold cavity and is removed from the top of the part after the molten metal solidifies.

According to other aspects of the invention, the mold may have a second side that is on the opposite side of the mold cavity from the first side. The thickness of the second side of the mold is less than the thickness of the first side of the mold. The molten metal is poured from the slot opening down one side of the first side of the cavity. The molten metal is poured at a predetermined temperature and begins to solidify as it accumulates in the cavity. The molten metal fills the cavity from the bottom of the cavity with lower temperature molten metal having a higher viscosity. The mold may also have a plurality of cores that are assembled inside the mold cavity and about which the molten metal flows.

According to another aspect of the invention, a method is provided for casting a metal part in a mold that defines a part-forming cavity. The mold has a riser that is disposed above and adjacent to a first side of the cavity. The riser has a direct pour passage that is generally circular in cross-section on a top end and generally an elongated slot-shaped on a bottom end with a smooth transition between the top end and the bottom end of the riser. The method comprises assembling cores into the cavity and a riser core on top of the mold and pouring molten metal directly into the top end of the direct pour passage. The part-forming cavity is filled with the molten metal that initially flows down a substantially vertical wall of the cavity and then flows across a bottom portion of the cavity, filling the cavity from the bottom around the cores in the cavity. After the molten metal solidifies in the cavity, solidified metal in the riser core is removed from the mold. Mold flash formed in the riser core during the pouring step is mechanically removed from the metal part.

According to other aspects of the invention as they relate to the method, the vertical wall of the part-forming cavity may be vertical or within 15 degrees of vertical. The cavity has a plurality of cores that are assembled within the cavity so that during the filling step the molten metal flows around the cores. The mold may be a permanent mold and the riser core may be formed as part of the permanent mold.

According to other aspects of the invention, the step of pouring the molten metal may be performed with a bottom pour ladle having a stopper rod for controlling the flow of molten metal through a hole in the bottom of the ladle. The method may further comprise supplying molten metal to the ladle from a holding furnace located adjacent to the mold.

According to yet another aspect of the invention, a cast part may be formed in a direct pour casting operation with relatively reduced temperature molten metal. The cast part comprises a first wall having a first thickness and a second wall having second thickness that is greater than the first thickness. The cast part has a top portion and an internal portion disposed between the first and second walls and below the top portion. The internal portion of the part is thicker than the first wall. The cast part is formed in a casting operation, wherein molten metal is poured into the mold through a direct pour port disposed at the top of the cavity that forms the first wall of the part. The molten metal flows downwardly through the first wall cavity and accumulates in the cavity from the bottom up to fill the second wall, internal portion and top portion as the molten metal cools in the mold and becomes increasing viscous until it hardens.

According to other aspects of the invention as they relate to the cast part, the cast part may be an engine head. The molten metal may be poured at a temperature that is lower than the temperature required to cast the part if it was to be formed in a mold having filling gates defined in the mold that fill the mold cavity from the bottom of the cavity. The cast part has reduced porosity and reduced hydrogen in the metal due to the lower pour temperature. Further, the cast part may have increased dendrite arm spacing and reduced copper segregation as a direct result of the direct pour process.

These and other aspects of the present invention will be better understood in view of the attached drawings and the following detailed description of the illustrated embodiment.

DETAILED DESCRIPTION OF THE PREFERRED EMBODIMENT(S)

Figure 1:
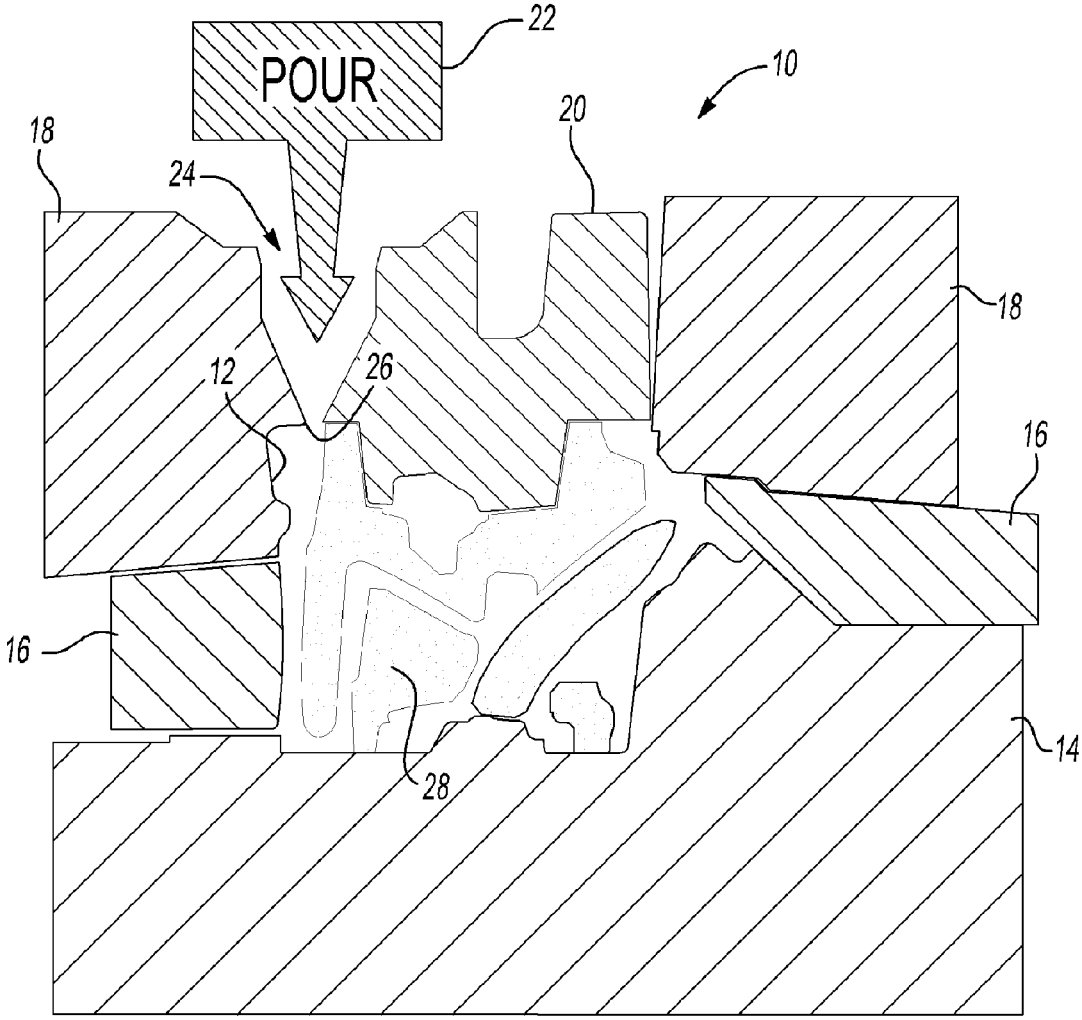
FIG. 1 is a schematic cross-sectional view of a metal casting mold made in accordance with the present invention.

Referring to FIG. 1, a metal casting mold for casting a metal part is generally indicated by reference numeral 10. The metal casting mold defines a mold cavity 12. The mold cavity 12 may take many different forms but as illustrated includes a mold base 14 that defines the lower portion of the mold cavity 12. A side mold part 16 forms at least in part the side portions of the mold cavity 12. An upper mold part 18 defines a portion of the upper part of the mold cavity 12. A mold top 20 abuts the upper mold part 18 to enclose the mold cavity 12.

In a casting process using the casting mold 10 of the present invention, a bottom pour ladle 22 is used to pour molten metal such as aluminum, iron or other metal for forming cast parts into a riser core 24. Riser core 24 is defined by the upper mold part 18 and mold top 20. The riser core 24 dispenses molten metal into a direct pour passage 26 as defined by the upper mold part 18 and mold top 20 in the illustrated embodiment. It should be understood that the direct pour passage 26 could be formed in the top of the mold cavity 12 by one or more other mold parts.

A plurality of cores 28 are assembled into the mold cavity 12 as the mold is built up for a casting operation. The cores 28 may be temporary or permanent cores. The cores 28 are used to provide openings in the finished metal part and to reduce the amount of metal required to form the metal part.

Figure 2:
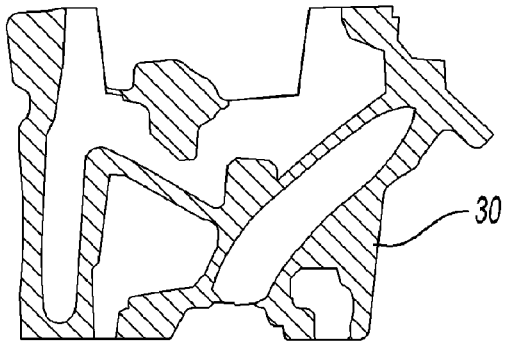
FIG. 2 is a cross-sectional view of an engine head made in the mold shown in FIG. 1.

Referring to FIG. 2, a cast engine head 30 is shown in cross-section. While the illustrated embodiment in FIG. 1 is a casting mold for an engine head 30, it is believed that a wide variety of other parts can be formed according to the present invention.

Figure 3:
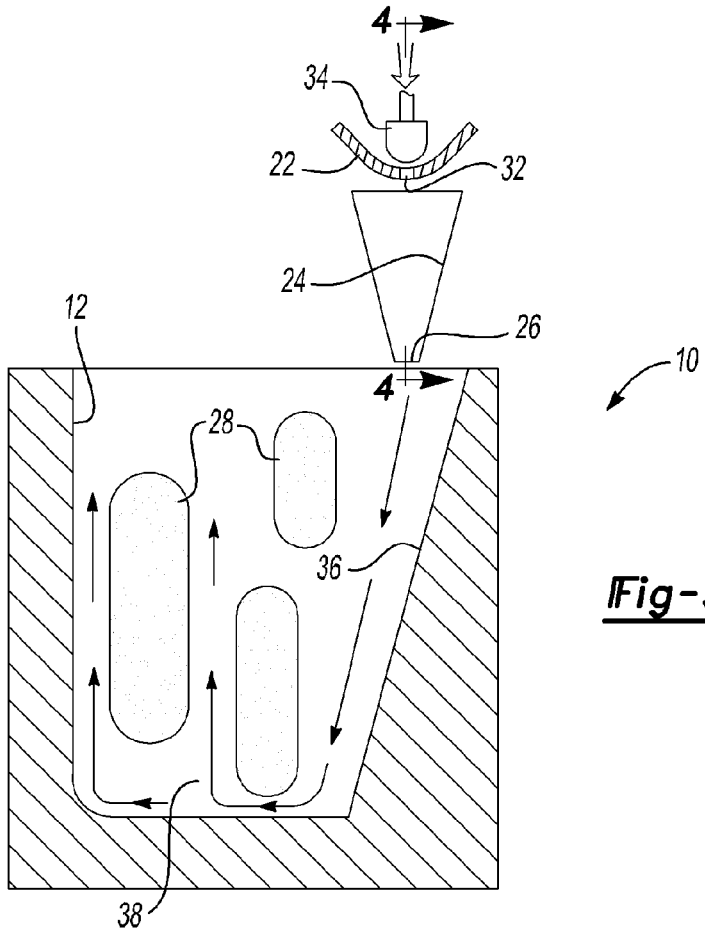
FIG. 3 is a diagrammatic cross-sectional view of a metal casting mold including a riser core and bottom pour ladle made in accordance with the present invention.

Referring to FIG. 3, the casting mold 10 is shown diagrammatically to further explain the casting process of the present invention. The mold 10 defines a mold cavity 12 in which a plurality of cores 28 are disposed to define inner passages in the finished part. In a casting operation using the mold 10, molten metal is dispensed from a bottom pour ladle 22 into a riser core 24 defined by portions of the mold. An opening 32 in the ladle 22 is selectively opened and closed by a stopper rod 34. When the stopper rod 34 is lifted to allow molten metal to flow through the opening 32, the molten metal flows onto a wall 36 of the mold cavity 12. The wall 36 is preferably a generally vertically extending wall which should be understood to be a wall that is oriented either vertically in the mold or within 15° of vertical as shown in FIG. 3. Molten metal flows down the wall 36 to the bottom portion 38 preferably in a controlled and non-turbulent manner. The molten metal should not be permitted to fall freely through the mold into the bottom portion 38 thereof to avoid oxides and other inclusions in the finished part.

Figure 5:
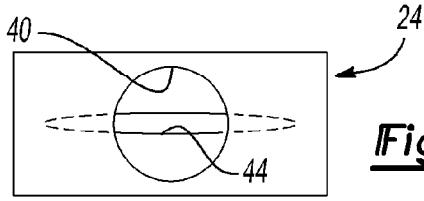
FIG. 5 is a top plan view taken along the line 5—5 in FIG. 4.

The riser core 24 is provided with a circular opening 40 that is adapted to receive the bottom pour ladle 22 in a close fitting relationship to avoid entraining oxygen and impurities as the metal is poured into the riser core 24. The riser defines an inverted funnel shaped passage that widens in the longitudinal direction and becomes progressively more narrow transversely. As shown in FIG. 5, the circular opening 40 of the riser core 24 is shown.

Figure 4:
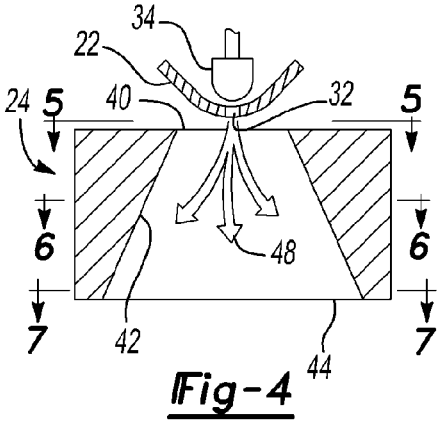
FIG. 4 is a longitudinal cross-sectional view of the riser core and bottom pour ladle.
Figure 6:
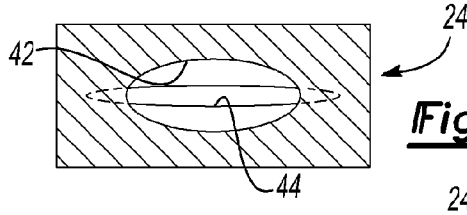
FIG. 6 is a cross-sectional view taken along the line 6—6 in FIG. 4.
Figure 7:
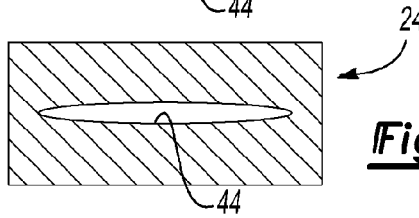
FIG. 7 is a cross-sectional view taken the line 7—7 in FIG. 4.

Referring to FIG. 6, the opening in the riser core is shown at intermediate level 42 where it is substantially oval shaped. As shown in FIGS. 4 and 7, the opening in the riser core 24 at the bottom of the riser core 24 is a slot opening 44. In FIG. 7, the slot opening 44 is shown at a point immediately above the direct pour passage 26 of the mold cavity 12. In FIG. 5, the slot opening 44 is shown as it is aligned with the circular opening 40. In FIG. 6, the slot opening 44 is shown in conjunction with the intermediate level opening 44.

Referring to FIG. 4, molten metal flow paths 48 are shown in a longitudinal cross-section view to be diverging as the molten metal flows from the circular opening 40 through the intermediate level 42 and through the slot opening 44.

The cross-sectional area of the slot opening 44 may be slightly less than the cross-sectional area of the circular opening 40 and intermediate level openings 42 so that during the metal pouring operation positive pressure is applied as the molten metal fills the riser core allowing it to pass through the slot opening 44 into the direct pour passage 26 defined in the mold cavity 12.

No filter is required in the bottom pour ladle 22 or direct pour passage 26 because flow control is achieved as a result of the structure of the riser core 24. No sleeve is required between the bottom pour ladle and the direct pour passage 26.

The bottom pour ladle is configured to be placed over the riser core 24 to avoid entraining impurities and oxides. The connection between the riser core 24 and the direct passage 26 forms a seal. The flow of molten metal is controlled by the slot opening 44 and is directed to a generally vertical wall surface. The molten metal flows down a first wall to the bottom portion 38 of the mold cavity 12 where it accumulates and begins to fill the mold cavity 12 from the bottom. The molten metal flows around the cores 28 in the mold cavity 12. The cores 28 may be sand cores or permanent cores as previously indicated. The molten metal cools as it is dispensed into the cavity 12 and tends to become more viscous. Full advantage of the present invention may be achieved by locating the direct pour passage centrally above a thinner wall of a molded part as defined by the cavity 12 so that the cooler more viscous metal may flow more easily through larger passages in the other portions of the part to be cast.

The bottom pour ladle reduces inclusions and oxides as the molten metal is poured into the direct pour passage 26. The bottom pour ladle is preferably a cylindrical ladle having a ceramic stopper rod.

When the casting operation is complete, the riser core 24 is disassembled from the casting mold 10. Any metal coating the inside of the riser core 24 may be mechanically removed and remelted. The mold 10 is also disassembled by removing the part from the mold base 14, side mold part 16 and upper mold part 18.

For example, in an engine head molding operation the exhaust wall of the head may be thinner than the intake wall. The direct pour passage 26 in this case is located above the thinner exhaust wall so that the hotter more fluid metal may flow into the mold and then fill the mold by filling the thicker wall portion defined in the intake wall of the engine head. Locating the direct pour passage 26 so that the molten metal flows into the mold against a nearly vertical surface results in a more even flow of metal down the wall. Erosion of the ceramic coating on the permanent mold is reduced by orienting the wall vertically or within 15° of vertical. If the angle of the wall against which the molten metal is directed is less vertical, erosion of the ceramic coating on the mold part is increased. When the casting operation is complete, any metal coating the riser core 24 may be broken off with a wedge or any normal milling procedure.

In operation, molten metal is poured through the opening 32 in the bottom pour ladle 22 by moving the stopper rod 34 from its position blocking the opening 32. The molten metal fills the in-gate chamber defined by the riser core 24 due to the restriction in the cross-sectional area of the slot opening 44 relative to the circular opening 44. The molten metal begins filling the mold immediately upon dispensing the molten metal from the bottom ladle 22 but at a controlled rate. The rate of metal flowed through the slot opening 44 is less than the rate at which the molten metal is received in the circular opening 40. The molten metal preferably flows through a thin wall of between 3 and 6 millimeters thick of the part to be formed and flows down the wall to the bottom portion 38 of the mold cavity 12. As the metal flows, it flows at a controlled rate and does not free fall to the bottom portion 38 of the mold cavity 12.

While the best mode for carrying out the invention has been described in detail, those familiar with the art to which this invention relates will recognize various alternative designs and embodiments for practicing the invention as defined by the following claims.

What is claimed is:

1. A machine for casting a metal part comprising:

a mold defining a mold cavity, riser core provided above the mold cavity, the riser core having a molten metal receiving opening, the opening being located above a first side of the mold cavity;

a bottom pour ladle having a metal dispensing opening in the bottom of the ladle and a stopper rod valve for opening and closing the molten metal dispensing opening; and the riser core having a circular opening on the top end and an elongated slot opening on the bottom of the riser core and extending along a portion of the first side of the mold cavity, the opening in the riser core being of increasing length in a first direction from top to bottom and being of decreasing width in a second direction from top to bottom, wherein the second direction is perpendicular to the first direction.

2. The machine for casting a metal part of claim 1 wherein the circular opening of the riser core has a first cross-sectional area and the slot opening of the riser core has a second cross-sectional area that is less than the first cross-sectional area, wherein positive pressure is applied as the molten metal fills the riser core.

3. The machine for casting a metal part of claim 1 wherein the opening in the riser core extends downwardly from the circular opening to the slot opening, the riser core defines an opening that has a continuously increasing length and a continuously decreasing width.

4. The machine for casting a metal part of claim 1 wherein the riser core is disposed above the mold cavity and is removed from the top of the part after the molten metal solidifies.

5. The machine for casting a metal part of claim 1 further comprising a second side of the mold cavity that is on the opposite side of the mold cavity from the first side, wherein the thickness of the second side of the mold cavity may be less than the thickness of the first side of the mold, and the molten metal is poured from the slot opening down a wall of the first side of the mold cavity.

6. The machine for casting a metal part of claim 1 wherein the molten metal is poured at a predetermined temperature begins to solidify as it accumulates in the cavity and fills the cavity from the bottom of the cavity with lower temperature molten metal having a higher viscosity.

7. The machine for casting a metal part of claim 1 wherein the mold has a plurality of cores assembled inside the mold cavity.

* * * * *